United States Patent [19]

Miller

[11] Patent Number: 4,550,646

[45] Date of Patent: Nov. 5, 1985

[54] METHOD AND ARRANGEMENT FOR RETAINING CYLINDER LINERS IN A RECIPROCATING PUMP

[75] Inventor: John E. Miller, Dallas, Tex.

[73] Assignee: Dresser Industries, Inc., Dallas, Tex.

[21] Appl. No.: 678,189

[22] Filed: Dec. 4, 1984

[51] Int. Cl.[4] ..... F16J 10/00

[52] U.S. Cl. ..... 92/128; 92/171; 417/568

[58] Field of Search ..... 92/128, 169, 171; 417/568

[56] References Cited

U.S. PATENT DOCUMENTS

| | | | |
|---|---|---|---|
| 1,837,675 | 12/1931 | Rick | 92/171 |
| 2,155,180 | 4/1939 | Caldwell | 92/171 |
| 2,260,440 | 10/1941 | Cunningham et al. | 92/171 |
| 2,943,895 | 7/1960 | Miller | 92/171 |

FOREIGN PATENT DOCUMENTS

| | | | |
|---|---|---|---|
| 1193017 | 5/1965 | Fed. Rep. of Germany | 417/568 |

*Primary Examiner*—Carlton R. Croyle
*Assistant Examiner*—Donald E. Stout
*Attorney, Agent, or Firm*—Fred A. Winans

[57] ABSTRACT

A fluid seal and retaining arrangement for securing a cylinder liner within the frame of a reciprocating piston pump. The frame and the cylinder liner cooperate to form an annular chamber within the frame about the periphery of the liner which is filled with pressurized hydraulic fluid to maintain a differential force securing the liner to the frame while providing a fluid-tight seal between the liner and the frame.

12 Claims, 2 Drawing Figures

METHOD AND ARRANGEMENT FOR RETAINING CYLINDER LINERS IN A RECIPROCATING PUMP

BACKGROUND OF THE INVENTION

1. Field of the Invention

This invention relates to reciprocating piston pumps and in particular to a fluid seal and retaining arrangement for securing cylinder liners within such pumps.

2. Description of the Prior Art

In the typical reciprocating pump used to pump drilling mud, coal slurrys and related fluids, each of the pistons reciprocate within a replaceable cylinder liner secured to the supporting frame of the pump. As will be readily appreciated, the abrasive character of such fluids necessitates the periodic replacement of the cylinder liners during normal use of such pumps.

U.S. Pat. Nos. 1,837,675 and 2,943,895 show reciprocating pumps which are fairly typical of those currently in use. As shown in those patents, both of those designs are provided with mechanical means for releasably clamping the cylinder liners within the supporting frame of the pump, and a fluid pressure sealing arrangement providing a fluid seal about the joint between the cylinder liners and the frame.

While the cylinder liner clamping arrangements heretofore available have been for the most part satisfactory, the separate clamping and sealing arrangements embodied in those designs have nevertheless been relatively complicated and sensitive to adjustment and maintenance in the field. Moreover, experience has demonstrated that it can often be a very difficult and time consuming task to remove the worn and corroded cylinder liners from the frame even after the clamps are removed.

SUMMARY OF THE INVENTION

The present invention relates to reciprocating piston pumps and in particular to a fluid seal and retaining arrangement for securing a replaceable cylinder liner within the frame of such a pump and a method for doing the same.

The invention provides for securing a tubular cylinder liner within a bore extending through the frame of the pump while also forming a fluid tight seal between the cylinder liner and the frame. The frame is provided with an annular mounting face at one end of the bore and a counterbore at the other end of the bore defining an annular ridge within the bore which is sized to slidingly receive the cylinder liner, it being noted that one end of the liner is provided with an annular cylinder sized to abut the mounting surface of the frame. To secure the cylinder liner to the frame, an annular sleeve is releasably secured about the liner within the counterbore to form an annular chamber between the annular sleeve and the juncture of the cylinder liner and the annular ridge within the bore. Then, by injecting fluid into the chamber through a passage in the frame and maintaining it at a pressure greater than the pressure of the fluid being conveyed by the pump, the invention provides for firmly securing the cylinder liner to the frame while also effecting a pressure barrier forming a fluid tight seal between the cylinder liner and the frame.

In addition to the above, the invention also effectively minimizes the area of the surfaces where the cylinder liner and the frame are in direct contact. This significantly simplifies installation and removal of the cylinder liner from the bore since it minimizes the effects of tolerance variations, corrosion, and scale buildup within the pump.

From the foregoing, it can be seen that the invention contemplates a reliable yet relatively straightforward construction for securing cylinder liners in reciprocating piston pumps such as used to convey coal slurries and the like. However, it is to be understood that various changes can be made in the arrangement, form and construction of the apparatus disclosed herein without departing from the scope and spirit of the invention.

DESCRIPTION OF THE PREFERRED EMBODIMENT

Figure 1:
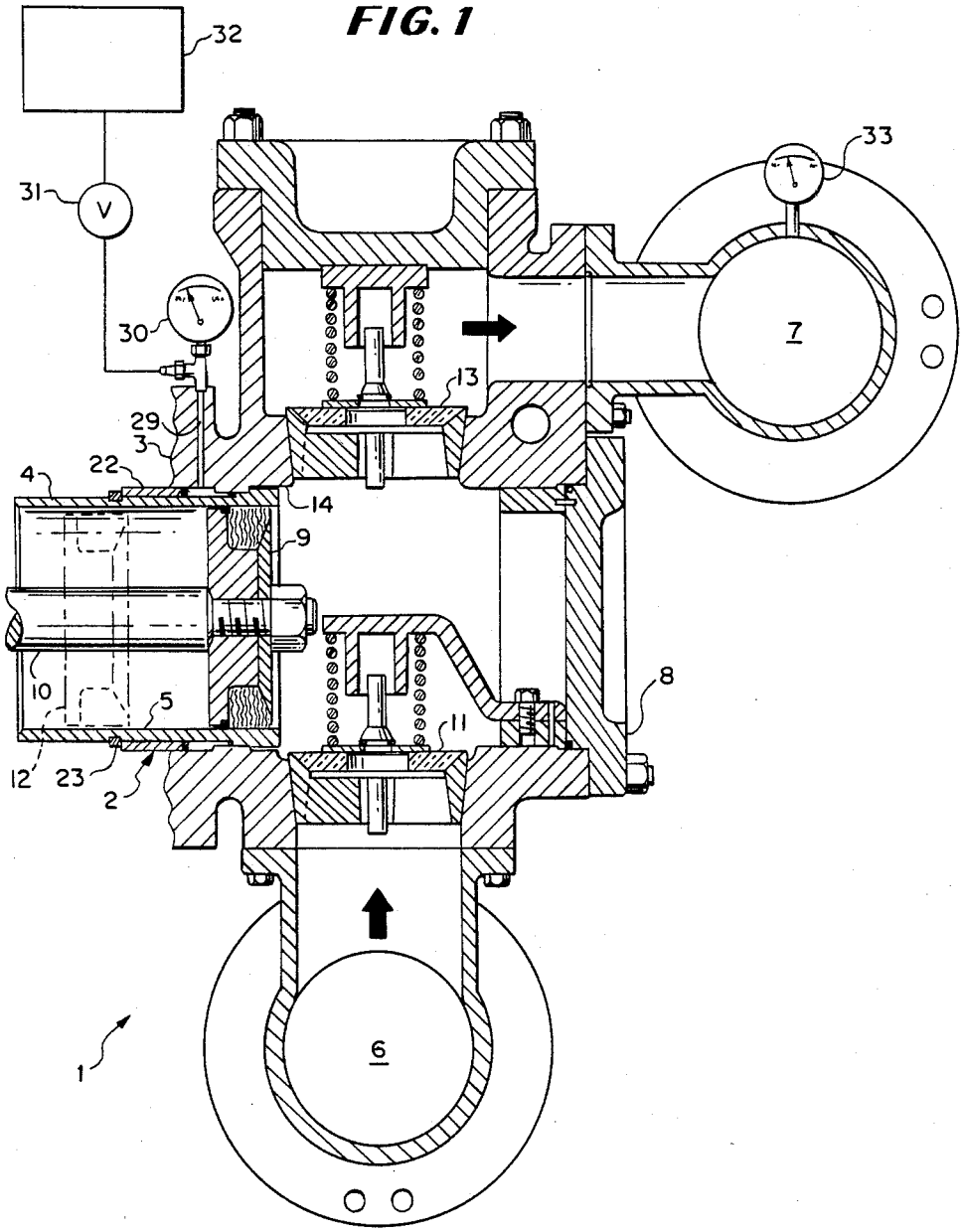
FIG. 1 is a fragmentary longitudinal sectional view showing a cylinder liner secured to a pump frame by the fluid seal and retaining arrangement embodying the invention.

As shown in FIG. 1, the liquid end of a reciprocating piston pump 1 incorporating the fluid seal and retaining arrangement 2 embodying the invention includes a metal frame 3, and abrasion resistant metal cylinder liner 4 supported by the frame forming a cylinder chamber 5, inlet and discharge ducts 6 and 7 in a conventional cylinder head 8, and a piston 9 adapted to be reciprocated in the cylinder liner 4 in the usual fashion by a piston rod 10 secured to the piston 9.

As in the typical pump of this type, during the normal operating cycle of the pump the fluid to be conveyed is first drawn into the cylinder chamber 5 from the inlet duct 6 through an inlet valve 11 as the piston 9 is retracted from the position shown in solid lines in FIG. 1 to the general position shown in phantom lines as indicated at 12. Then, as the piston 9 is returned to its original position to complete the cycle and begin another cycle, the fluid is pumped out of the cylinder chamber 5 into the discharge duct 7 through a discharge valve 13.

Turning to the specific construction of the fluid seal and retaining arrangement 2, the pump frame 3 is provided with a bore or hole 14 extending through the frame 3 which is sized to receive the tubular cylinder liner 4. As shown in the drawings, the bore 14 is counterbored at each of its ends with counterbores 15 and 16 to form an inwardly projecting annular ridge 17 which is sized to snuggly fit around the periphery of the tubular cylinder liner 4.

Figure 2:
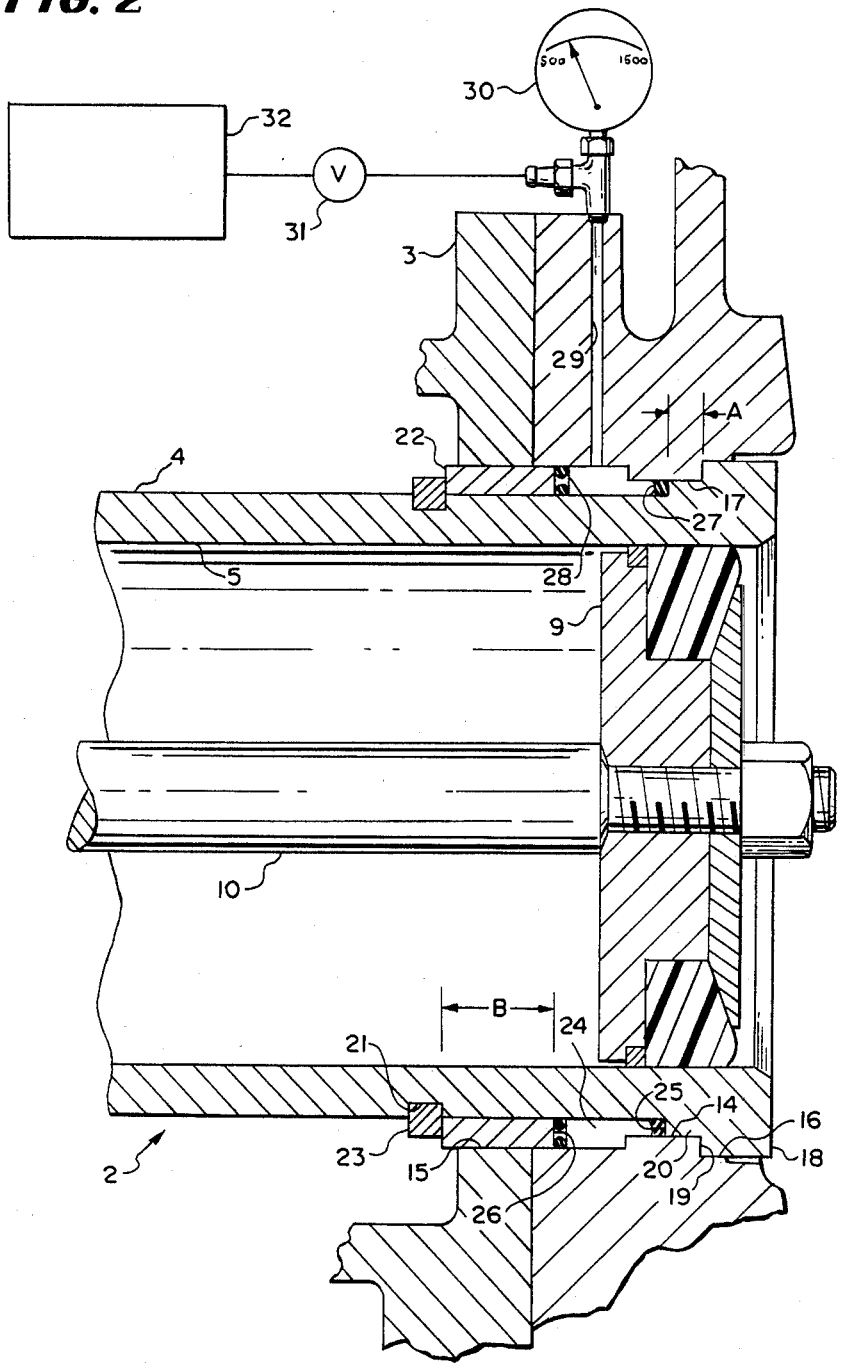
FIG. 2 is an enlarged fragmentary sectional view of the fluid seal and retaining arrangement shown in FIG. 1.

Referring to FIG. 2, the tubular cylinder liner 4 is provided with an outer first annular shoulder 18 and an inwardly extendly second annular shoulder 20. The first annular shoulder 20 is sized to about the outer marginal edge or mounting face 19 of the annular ridge 17 within the counterbore 16, and the second annular shoulder 20 is sized to snuggly slide within the bore 14. Additionally, for reasons which will be described, a peripheral notch or groove 21 is formed about the circumference of the cylinder liner 4 spaced outwardly from the edge of the frame 3.

The tubular cylinder liner 4 is secured to the frame 3 by an annular sleeve 22 which is sized to slip over the inner end of the cylinder liner and then be slid along its length until the sleeve is engaged in the counterbore 15.

Once the sleeve 22 is engaged in the counterbore 15, it is secured or entrained within the counterbore 15 by a split ring 23 or other well known means releasable received in the groove 21 extending around the circumference of the cylinder liner 4. As can be seen from the drawings, this arrangement forms an annular pressure chamber 24 between the inner annular face 25 of the second annular shoulder 20 and the inner face 26 of the sleeve 22. In this regard, it should be noted that annular packing rings 27 and 28 are also secured about the circumference of the cylinder liner 4 in a fashion abutting the inner faces 25 and 26, respectively, to form a fluid-tight seal between the liner 4 and the frame 3 at the sides of the chamber 24.

In order to assure that the fluid being conveyed by the pump does not seep between the cylinder liner and the frame, the invention calls for pressurizing the annular chamber 24 with hydraulic fluid to form a positive fluid pressure barrier within the chamber. Specifically, as shown in FIG. 2, the frame 3 is provided with a passage 29 communicating with the chamber 24 which is connected to a pressure gauge 30, a pressure regulating valve 31 and a source of pressurized hydraulic fluid 32. While it is to be understood that a variety of pressurized fluid sources 32 could be used for this purpose, such as the pump and accumulator arrangement shown in U.S. Pat. No. 2,943,895 noted above in regard to prior art, experience has indicated that the pressure of the hydraulic fluid in the chamber 24 should preferrably be maintained at a pressure equal to or greater than than the pressure of the fluid being conveyed by the pump. Thus, if the maximum pressure of the fluid in the cylinder chamber 5 is about 1400 psi as indicated by a suitable pressure gauge 33 connected to the outlet duct 7, the pressure of the hydraulic fluid in the annular chamber 24 should be maintained at a pressure of at least 1400 psi. This is accomplished by simply monitoring the pressure gauges 30 and 33 and then adjusting the pressure of the hydraulic fluid, if appropriate, by adjusting the pressure regulating valve 31.

In addition to forming a fluid pressure barrier against seepage of the fluid being conveyed by the pump, the pressurized hydraulic fluid in the annular chamber 24 also secures the cylinder liner 4 within the frame 3. More particularly, since the area of the inner annular face 26 of the sleeve 22 is greater than the area of the annular face 25 of the second annular shoulder 20, the pressurized hydraulic fluid maintains a differential force against the sleeve which is in turn transferred through the split ring 23 to the cylinder liner 4 to draw the outer annular shoulder 18 against the mounting face 19 to secure the cylinder liner within the frame. This establishes a relatively rigid metal-to-metal bearing contact between the liner and the frame.

From the foregoing, it can be seen that the invention contemplates a straightforward construction which accommodates relatively easy installation and replacement of the cylinder liner. For example, after removing the cylinder head 8 in the conventional fashion and releasing or depressurizing the hydraulic fluid to ambient pressure, a workman can remove the worn cylinder liner 4 by simply removing the split ring 23 and then sliding the cylinder liner out of the bore 14. In the event that the cylinder liner cannot be readily slid out of the bore after the split ring is removed due to corrosion or the like, the workman can gradually pressurize the hydraulic fluid in the annular chamber 24 by adjusting the regulating valve 31 to urge the sleeve 22 out of the counterbore 15. Thereafter, once the sleeve is removed, the cylinder liner can be easily slid out of the bore and replaced with a new cylinder liner secured in the same fashion. In this regard, it should be noted that the second annular shoulder 20 provides the only direct contact between the bearing liner and the frame within the bore 14. In contrast to the arrangement shown in U.S. Pat. No. 2,943,895 wherein a second annular ridge is formed in the frame to stabilize the inner end of the cylinder liner, the invention utilizes the removable annular sleeve 22 for this purpose as well as to secure the cylinder liner in the frame. Thus, as illustrated in FIG. 2, the direct surface contact between the cylinder liner and the frame only extends the distance indicated at "A" instead of the sum of the distances indicated at "A" and "B". This significantly reduces the chance of the cylinder liner binding in the bore as it is installed due to slight tolerance variations or corrosion and the like.

The embodiments of the invention in which an exclusive property or privilege is claimed are defined as follows:

1. In a reciprocating piston pump including a frame having a bore and a tubular piston cylinder liner mounted within the bore supported by the frame, the improvement comprising a seal and retaining arrangement securing the cylinder liner to the frame, wherein:

said frame includes an annular mounting face at one end of said bore and a counterbore at the other end of the bore of a predetermined diameter relative to the diameter of the bore defining an annular ridge extending from said mounting face;

said cylinder liner is received within said bore in sliding engagement with said annular ridge and is provided with an annular shoulder abutting said mounting face;

a removable annular sleeve is releasably secured about said cylinder liner and is slidingly received within said counterbore to form an annular chamber between the juncture of said annular ridge and the cylinder liner and said sleeve;

a passage is provided in the frame communicating with said annular chamber; and a source of pressurized fluid is connected with said passage for introducing fluid into said annular chamber at a predetermined pressure to prevent the ingress of the fluid being conveyed by the pump into the chamber while maintaining a differential force against the sleeve to secure the cylinder liner within the frame.

2. The fluid seal and retaining arrangement in the piston pump of claim 1, wherein :

said cylinder liner includes a second annular shoulder extending inwardly from said first annular shoulder in sliding engagement with said annular ridge.

3. The fluid seal and retaining arrangement in the piston pump of claim 2, wherein:

a pair of spaced apart packing rings are secured about said cylinder liner within said annular chamber in a fashion abutting said annular sleeve and said second annular shoulder, respectively, to form an essentially fluid-tight seal between the cylinder liner and the frame.

4. The fluid seal and retaining arrangement in the piston pump of claim 1, wherein:

retaining means releasably secure said annular sleeve to said cylinder liner outwardly of said frame.

5. The fluid seal and retaining arrangement in the piston pump of claim 4, wherein:

said retaining means includes an annular groove formed in the circumference of said cylindrical liner and a split ring removably disposed in said groove diametrically sized to outwardly abut said annular sleeve.

6. The fluid seal and retaining arrangement in the piston pump of claim 1, wherein:

said frame includes a second counterbore at said one end of the bore forming said mounting face on said annular ridge.

7. The fluid seal and retaining arrangement in the piston pump of claim 1, wherein:

a pair of spaced apart packing rings are secured between said cylinder liner and said frame on the sides of said annular chamber.

8. The fluid seal and retaining arrangement in the piston pump of claim 1, wherein:

said source of pressurized fluid is adapted to maintain the fluid pressure in said annular chamber at a pressure greater than the pressure of the fluid being conveyed by the pump.

9. The fluid seal and retaining arrangement in the piston pump of claim 1, wherein:

said source of pressurized fluid is adapted to introduce hydraulic fluid into said annular chamber.

10. A method for securing a tubular cylinder liner in a bore extending through the frame of a reciprocating piston pump wherein the cylinder liner is provided with an annular shoulder at one of its ends, and the frame is provided with an annular mounting face at one end of the bore and a counterbore extending from the other end of the bore defining an annular ridge extending from said mounting face, comprising the steps of:

positioning said cylinder liner in sliding engagement with said annular ridge with said annular shoulder generally abutting the annular mounting face of the frame;

engaging an annular sleeve about the cylinder liner and positioning it in sliding engagement with the frame within the counterbore to form an annular chamber between the juncture of said annular ridge and the cylinder liner and said annular sleeve;

releasably securing the annular sleeve to the cylinder liner to retain the annular sleeve within the counterbore; and filling the annular chamber with hydraulic fluid through a passage in the frame and maintaining it at a predetermined pressure to form a pressure barrier preventing the ingress of the fluid being conveyed by the pump into the chamber while maintaining a differential force against the sleeve to secure the cylinder liner within the frame.

11. The method of claim 10, and maintaining the hydraulic fluid in the annular chamber at a pressure at least the same as the pressure of the fluid being conveyed by the pump.

12. The method of claim 10, and the subsequent disassembly steps of:

releasing the pressure on the hydraulic fluid in the annular chamber to a predetermined pressure;

releasing the annular sleeve from the cylinder liner to accommodate removal of the annular sleeve from the counterbore; and selectively pressurizing the hydraulic fluid in the annular chamber to urge the annular sleeve out of the counterbore.

* * * * *